US006478657B1

(12) United States Patent
Shibata

(10) Patent No.: US 6,478,657 B1
(45) Date of Patent: Nov. 12, 2002

(54) EYEGLASS LENS PROCESSING APPARATUS

(75) Inventor: Ryoji Shibata, Aichi (JP)

(73) Assignee: Nidek Co., Ltd., Aichi (JP)

( * ) Notice: Subject to any disclaimer, the term of this patent is extended or adjusted under 35 U.S.C. 154(b) by 0 days.

(21) Appl. No.: 09/612,252

(22) Filed: Jul. 7, 2000

(30) Foreign Application Priority Data

Jul. 7, 1999 (JP) ..... 11-193768

(51) Int. Cl.[7] ..... B24B 9/08
(52) U.S. Cl. ..... 451/5; 451/43; 451/255
(58) Field of Search ..... 451/5, 43, 44, 451/255, 256

(56) References Cited

U.S. PATENT DOCUMENTS

| | | | | |
|---|---|---|---|---|
| 5,053,971 A | * 10/1991 | Wood et al. | 451/43 |
| 5,056,270 A | * 10/1991 | Curcher | 451/43 |
| 5,074,079 A | * 12/1991 | Park | 451/43 |
| 5,138,770 A | 8/1992 | Matsuyama | 33/28 |
| 5,228,242 A | 7/1993 | Matsuyama | 51/165.74 |
| 5,333,412 A | 8/1994 | Matsuyama | 51/165.71 |
| 5,775,973 A | 7/1998 | Watanabe | 451/5 |
| RE35,898 E | 9/1998 | Shibata et al. | 451/5 |
| 6,050,877 A | 4/2000 | Shibata et al. | 451/5 |
| 6,062,947 A | 5/2000 | Obayashi et al. | 451/5 |

FOREIGN PATENT DOCUMENTS

| | | | |
|---|---|---|---|
| EP | 0 839 609 A1 | 5/1998 | B24B/47/22 |
| EP | 0 890 414 A2 | 1/1999 | B24B/9/14 |
| JP | 1-124013 | 5/1989 | G05F/3/22 |
| JP | 3-11526 | 1/1991 | H01J/23/10 |
| JP | 3-20603 | 1/1991 | G01B/5/06 |
| JP | 9-277148 | 10/1997 | B24B/9/14 |
| JP | 2771547 | 4/1998 | B24B/9/14 |
| JP | 2907974 | 4/1999 | B24B/9/14 |
| JP | 2918657 | 4/1999 | B24B/9/14 |
| JP | 2925685 | 5/1999 | B24B/9/14 |

OTHER PUBLICATIONS

Catalog of Lens Edger from Briot International s.a.

* cited by examiner

*Primary Examiner*—Robert A. Rose
(74) *Attorney, Agent, or Firm*—Sughrue Mion, PLLC

(57) ABSTRACT

In an eyeglass lens processing apparatus for processing a periphery of an eyeglass lens, a lens is held and rotated, and a chamfering abrasive wheel rotating shaft axially supports at least one chamfering abrasive wheel and has a rotational axis different from an axis about which a rough abrasive wheel and a finish abrasive wheel are rotatable. The chamfering abrasive wheel is moved between a retreated position and a processing position. The chamfering abrasive wheel is urged toward the lens during chamfering processing. Position data of a corner portion of the periphery of the lens are detected based on target lens shape data of an eyeglass frame or a template and layout data of the lens with respect to a target lens shape. An arithmetic system obtains position data of a contact point between the lens and the chamfering abrasive wheel with respect to a rotational angle of the lens based on the position data of the corner portion of the periphery thus obtained and configuration data of a processing surface of the chamfering abrasive wheel, and obtains lens rotational velocity data for making a moving speed of the contact point substantially constant based on the position data of the contact point thus obtained.

23 Claims, 12 Drawing Sheets

EYEGLASS LENS PROCESSING APPARATUS

BACKGROUND OF THE INVENTION

The present invention relates to an eyeglass-lens processing apparatus for processing a peripheral edge of an eyeglass lens.

An eyeglass-lens processing apparatus for processing a peripheral edge of an eyeglass lens in conformity with the shape of an eyeglass frame is known. With this type of apparatus, the eyeglass lens after being roughly processed is subjected to finish processing by a finish abrasive wheel, but since the processed lens has corners on both sides, the corners are further subjected to chamfering.

Conventionally, this chamfering is manually performed by an operator by using a so-called hand grinder having a rotating conical abrasive wheel. Further, there is another type of processing apparatus in which a chamfering abrasive wheel is provided separately from the grinding abrasive wheel, and chamfering is effected by applying a fixed load between the chamfering abrasive wheel and the lens while rotating the lens held on a lens rotating shaft (lens chuck shaft).

However, the manual chamfering using the hand grinder is not easy to perform, and expert skill is required for performing a desired amount of chamfering, so that it is difficult for a person unskilled in the processing to perform satisfactory chamfering.

In addition, with the apparatus in which a fixed load is applied between the chamfering abrasive wheel and the lens, since the rotating speed of the lens is generally fixed, there are cases where the chamfering of a desired amount cannot be performed.

SUMMARY OF THE INVENTION

In view of the above-described problems of the conventional art, an object of the invention is to provide an eyeglass-lens processing apparatus which makes it possible to perform satisfactory chamfering easily.

Another object of the invention is to provide an eyeglass-lens processing apparatus which is used jointly with a grooving mechanism and makes it possible to perform useful chamfering.

The present invention provides the following arrangements:

(1) An eyeglass lens processing apparatus for processing a periphery of an eyeglass lens, comprising:
- lens rotating means for holding and rotating the lens;
- a chamfering abrasive wheel rotating shaft axially supporting at least one chamfering abrasive wheel and having a rotational axis different from an axis which a rough abrasive wheel and a finish abrasive wheel are rotatable;
- moving means for moving the chamfering abrasive wheel between a retreated position and a processing position;
- urging means for urging the chamfering abrasive wheel toward the lens during chamfering processing;
- detecting means for obtaining position data of a corner portion of the periphery of the lens based on target lens shape data of an eyeglass frame or a template and layout data of the lens with respect to a target lens shape;
- arithmetic means for obtaining position data of a contact point between the lens and the chamfering abrasive wheel with respect to a rotational angle of the lens based on the position data of the corner portion of the periphery thus obtained and configuration data of a processing surface of the chamfering abrasive wheel, and obtaining lens rotational velocity data for making a moving speed of the contact point substantially constant based on the position data of the contact point thus obtained; and
- control means for controlling operation of the lens rotating means based on the lens rotational velocity data thus obtained.

(2) The eyeglass lens processing apparatus of (1), wherein the chamfering abrasive wheel rotating shaft supports the chamfering abrasive wheel and a grooving abrasive wheel coaxially.

(3) The eyeglass lens processing apparatus of (2), wherein the chamfering abrasive wheel rotating shaft axially supports the chamfering abrasive wheels and the grooving abrasive wheel interposed between the chamfering abrasive wheels, each of the chamfering abrasive wheels having a processing surface decreased in diameter as it is located further from the grooving abrasive wheel.

(4) The eyeglass lens processing apparatus of (1), wherein the chamfering abrasive wheel rotating shaft is inclined relative to a rotational axis of the lens rotating means.

(5) The eyeglass lens processing apparatus of (4), wherein the chamfering abrasive wheel rotating shaft is inclined at an angle of about 8 degrees relative to the rotational axis of the lens rotating means.

(6) The eyeglass lens processing apparatus of (1), wherein the chamfering abrasive wheel rotating shaft supports the chamfering abrasive wheel and a grooving abrasive wheel coaxially, and inclined relative to a rotational axis of the lens rotating means so that the grooving abrasive wheel extends along a curvature of an optical plane of the lens.

(7) The eyeglass lens processing apparatus of (1), further comprising:
- an input key for changing a chamfering amount;
- wherein the arithmetic means obtains the lens rotational velocity data in accordance with the chamfering amount designated by the input key.

(8) The eyeglass lens processing apparatus of (1), further comprising:
- an input key for changing a chamfering amount;
- wherein the control means controls rotation number of the lens required for the chamfering processing in accordance with the chamfering amount designated by the input key.

(9) The eyeglass lens processing apparatus of (1), further comprising:
- selecting means for selecting whether or not the chamfering processing is performed.

(10) The eyeglass lens processing apparatus of (1), wherein:
- an arithmetic means obtains chamfering processing data based on radius vector data and peripheral edge position data based on the target lens shape data and the layout data; and
- the control means controls, based on the chamfering processing data thus obtained, an axis-to-axis distance between a rotational axis of the lens rotating means and the rotational axis of the chamfering abrasive wheel rotating shaft, and a relative position of the lens with respect to the chamfering abrasive wheel in a direction of the rotational axis of the lens.

(11) The eyeglass lens processing apparatus of (1), wherein:

the chamfering abrasive wheel rotating shaft supports the chamfering abrasive wheel and a grooving abrasive wheel coaxially;

the arithmetic means obtains grooving processing data based on radius vector data and peripheral edge position data based on the target lens shape data and the layout data; and the control means controls, based on the grooving processing data thus obtained, an axis-to-axis distance between a rotational axis of the lens rotating means and the rotational axis of the chamfering abrasive wheel rotating shaft, and a relative position of the lens with respect to the grooving abrasive wheel in a direction of the rotational axis of the lens.

(12) An eyeglass lens processing apparatus for processing a periphery of an eyeglass lens, comprising:

lens rotating means for holding and rotating the lens;

a chamfering abrasive wheel rotating shaft axially supporting at least one chamfering abrasive wheel and a grooving abrasive wheel coaxially and having a rotational axis different from an axis about which a rough abrasive wheel and a finish abrasive wheel are rotatable, the chamfering abrasive wheel rotating shaft being inclined relative to a rotational axis of the lens rotating means so that the grooving abrasive wheel extends along a curvature of an optical plane of the lens.;

moving means for moving the chamfering abrasive wheel between a retreated position and a processing position;

detecting means for obtaining position data of a corner portion of the periphery of the lens based on target lens shape data of an eyeglass frame or a template and layout data of the lens with respect to a target lens shape;

arithmetic means for obtaining position data of a contact point between the lens and the chamfering abrasive wheel with respect to a rotational angle of the lens based on the position data of the corner portion of the periphery thus obtained and configuration data of a processing surface of the chamfering abrasive wheel; and control means for controlling operation of the lens rotating means based on the position data of the contact point thus obtained.

(13) The eyeglass lens processing apparatus of (12), wherein the chamfering abrasive wheel rotating shaft axially supports the chamfering abrasive wheels and the grooving abrasive wheel interposed between the chamfering abrasive wheels, each of the chamfering abrasive wheels having a processing surface decreased in diameter as it is located further from the grooving abrasive wheel.

(14) The eyeglass lens processing apparatus of (12), wherein the chamfering abrasive wheel rotating shaft is inclined at an angle of about 8 degree relative to the rotational axis of the lens rotating means.

(15) An eyeglass lens processing apparatus for processing a periphery of an eyeglass lens, comprising:

a lens processing unit including:

a lens chuck shaft which holds and rotates the lens;

a first abrasive wheel rotating shaft which rotates a rough abrasive wheel and a finish abrasive wheel;

a second abrasive wheel rotating shaft which rotates a chamfering abrasive wheel;

a moving mechanism which moves the chamfering abrasive wheel between a retreated position and a processing position; and an urging mechanism which urges the chamfering abrasive wheel toward the lens during chamfering processing;

an input unit which inputs target lens shape data of an eyeglass frame or a template and layout data of the lens with respect to a target lens shape;

a lens measuring unit which obtains position data of a corner portion of the periphery of the lens based on the target lens shape data and the layout data thus inputted; and an arithmetic control unit which obtains position data of a contact point between the lens and the chamfering abrasive wheel with respect to a rotational angle of the lens based on the position data of the corner portion of the periphery thus obtained and configuration data of a processing surface of the chamfering abrasive wheel, obtains lens rotational velocity data for making a moving speed of the contact point substantially constant based on the position data of the contact point thus obtained, and controls operation of the lens chuck shaft based on the lens rotational velocity data thus obtained.

(16) The eyeglass lens processing apparatus of (15), wherein the second abrasive wheel rotating shaft supports the chamfering abrasive wheel and a grooving abrasive wheel coaxially.

(17) The eyeglass lens processing apparatus of (16), wherein the second abrasive wheel rotating shaft axially supports the chamfering abrasive wheels and the grooving abrasive wheel interposed between the chamfering abrasive wheels, each of the chamfering abrasive wheels having a processing surface decreased in diameter as it is located further from the grooving abrasive wheel.

(18) The eyeglass lens processing apparatus of (15), wherein the second abrasive wheel rotating shaft is inclined relative to a rotational axis of the lens chuck shaft.

(19) The eyeglass lens processing apparatus of (15), wherein the second abrasive wheel rotating shaft is inclined at an angle of about 8 degrees relative to the rotational axis of the lens chuck shaft.

(20) The eyeglass lens processing apparatus of (15) wherein the second abrasive wheel rotating shaft supports the chamfering abrasive wheel and a grooving abrasive wheel coaxially, and inclined relative to a rotational axis of the lens chuck shaft so that the grooving abrasive wheel extends along a curvature of an optical plane of the lens.

(21) The eyeglass lens processing apparatus of (15), further comprising:

an input key which changes a chamfering amount;

wherein the arithmetic control unit obtains the lens rotational velocity data in accordance with the chamfering amount designated by the input key.

(22) The eyeglass lens processing apparatus of (15), further comprising:

an input key which changes a chamfering amount;

wherein the arithmetic control unit controls rotation number of the lens required for the chamfering processing in accordance with the chamfering amount designated by the input key.

(23) The eyeglass lens processing apparatus of (15), wherein:

the arithmetic control unit obtains chamfering processing data based on radius vector data and peripheral edge position data based on the target lens shape data and the layout data, and controls, based on the chamfering processing data thus obtained, an axis-to-axis distance between a rotational axis of the lens chuck shaft and the rotational axis of the second abrasive wheel rotating shaft, and a relative position of the lens with respect to the chamfering abrasive wheel in a direction of the rotational axis of the lens.

(24) The eyeglass lens processing apparatus of (15), wherein:

the second abrasive wheel rotating shaft supports the chamfering abrasive wheel and a grooving abrasive wheel coaxially; and the arithmetic control unit obtains grooving processing data based on radius vector data and peripheral edge position data based on the target lens shape data and the layout data, and controls, based on the grooving processing data thus obtained, an axis-to-axis distance between a rotational axis of the lens chuck shaft and the rotational axis of the second abrasive wheel rotating shaft, and a relative position of the lens with respect to the grooving abrasive wheel in a direction of the rotational axis of the lens.

The present disclosure relates to the subject matter contained in Japanese patent application No. Hei. 11-193768 (filed on Jul. 7, 1999), which is expressly incorporated herein by reference in its entirety.

DESCRIPTION OF THE PREFERRED EMBODIMENT

Hereinafter, a description will be given of an embodiment of the invention.

(1) Overall Construction

Figure 1:
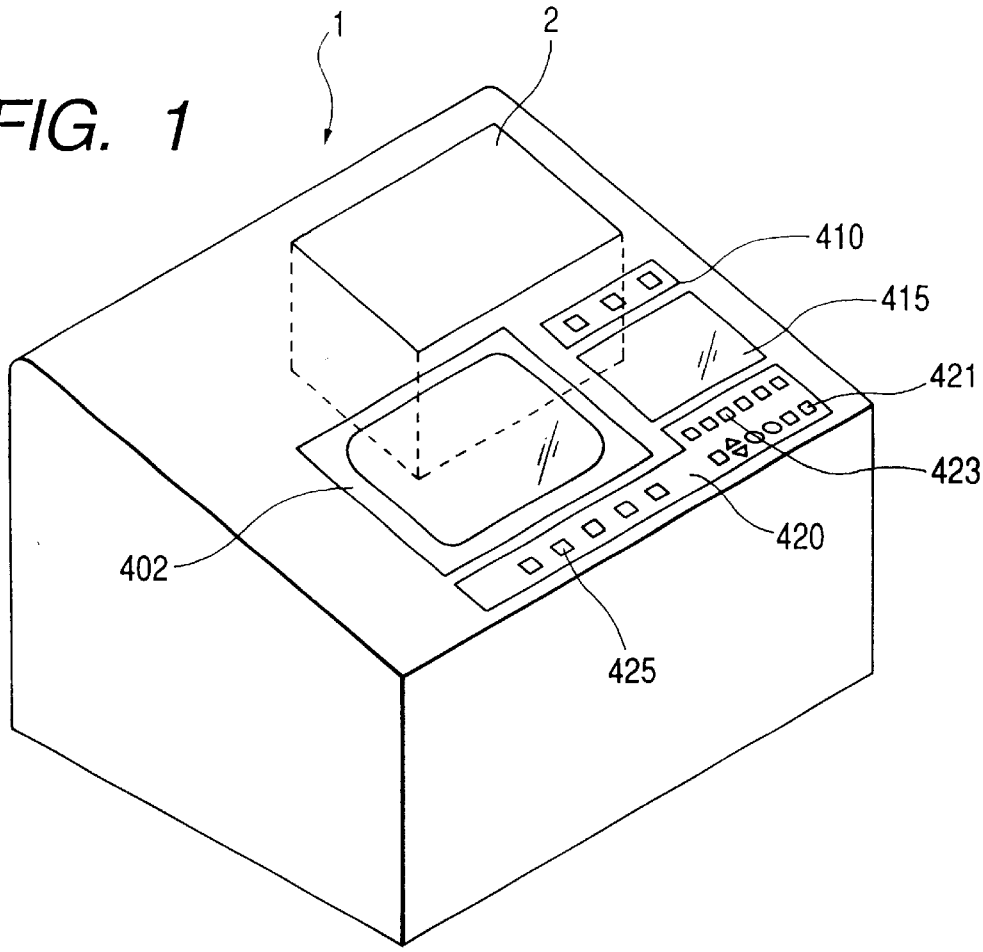
FIG. 1 is a diagram illustrating the external configuration of an eyeglass-lens processing apparatus in accordance with the invention.

FIG. 1 is a diagram illustrating the external configuration of an eyeglass-lens processing apparatus in accordance with the invention. An eyeglass-frame-shape measuring device 2 is incorporated in an upper right-hand rear portion of the main body 1 of the apparatus.

As the frame-shape measuring apparatus 2, ones that disclosed in U.S. Pat. No. 5,228,242, 5,333,412, U.S. Pat. No. 5,347,762 (Re. Pat. No. 35,898) and so on, the assignee of which is the same as the present application, can used. As switch panel section 410 having switches for operating the frame-shape measuring device 2 and a display 415 for displaying processing information and the like are disposed in front of the frame-shape measuring device 2.

Further, reference numeral 420 denotes a switch panel section having various switches for inputting processing conditions and the like and for giving instructions for processing, and numeral 402 denotes an openable window for a processing chamber.

Figure 2:
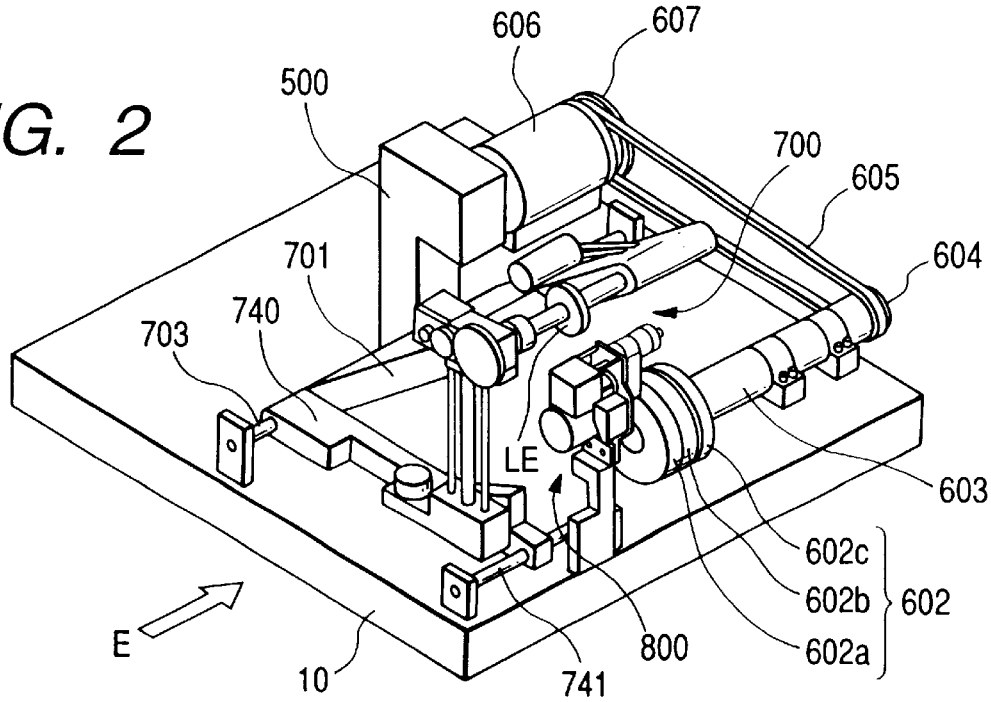
FIG. 2 is a perspective view illustrating the arrangement of a lens processing section disposed in a casing of a main body of the apparatus.

FIG. 2 is a perspective view illustrating the arrangement of a lens processing section disposed in the casing of the main body 1. A carriage unit 700 is mounted on a base 10, and a subject lens LE clamped by a pair of lens chuck shafts of a carriage 701 is ground by a group of abrasive wheels 602 attached to a rotating shaft 601. The group of abrasive wheels 602 include a rough abrasive wheel 602*a* for glass lenses, a rough abrasive wheel 602*b* for plastic lenses, and a finishing abrasive wheel 602*c* for beveling processing and flat processing. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606.

A lens-shape measuring section 500 is provided in the rear of the carriage 701. Further, a chamfering and grooving mechanism section 800 is provided in the front side.

(2) Construction of Various Sections (A) Carriage Section

Figure 3A:
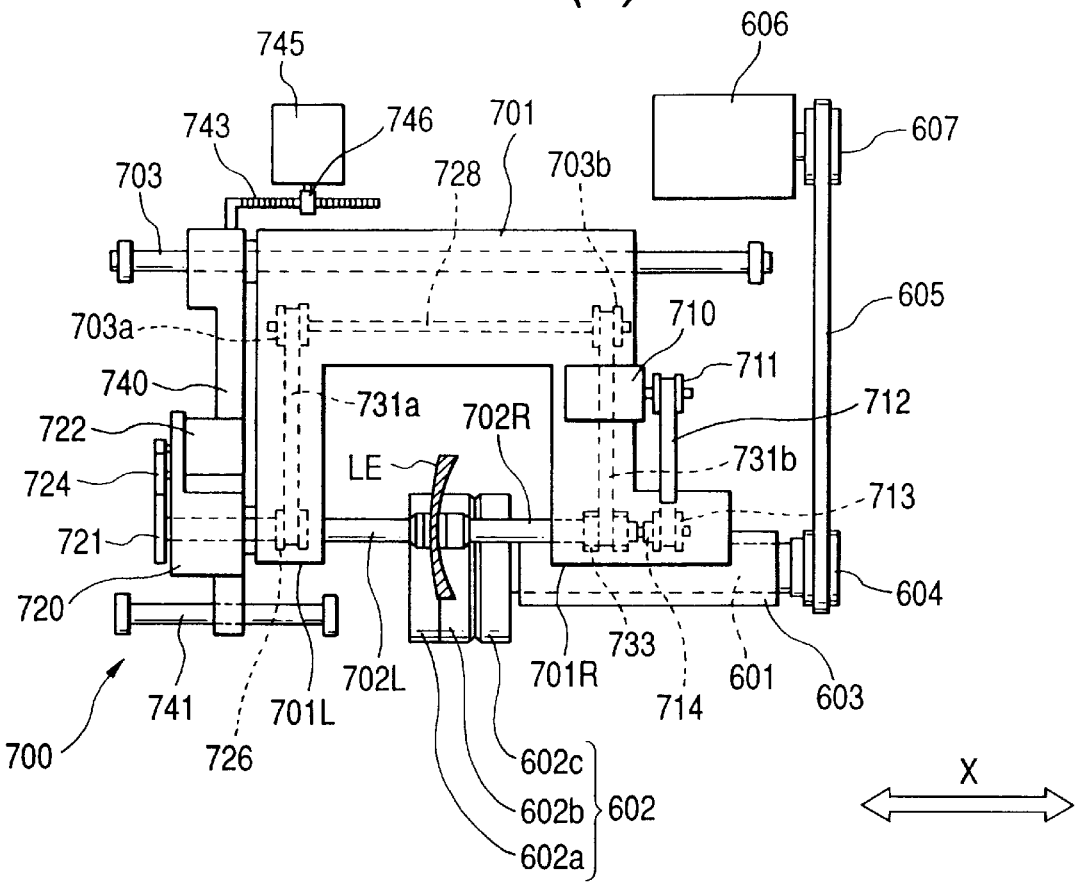
FIGS. 3(*a*) and 3(*b*) are schematic diagrams of essential portions of a carriage section.
Figure 3B:
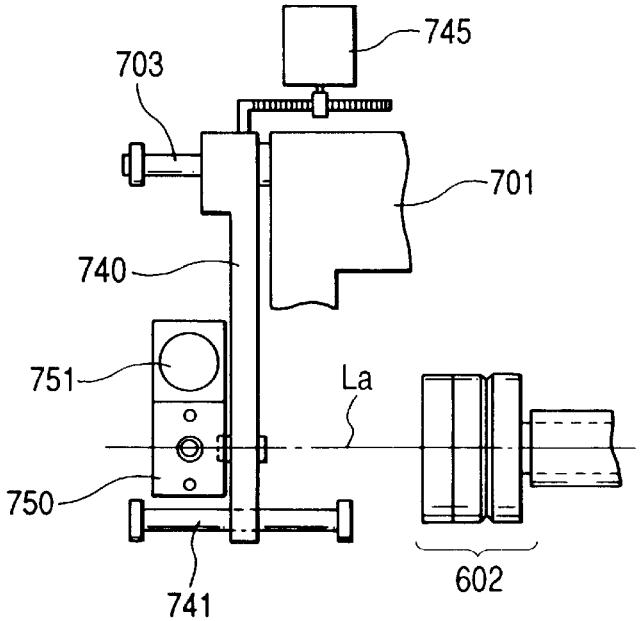
Figure 4:
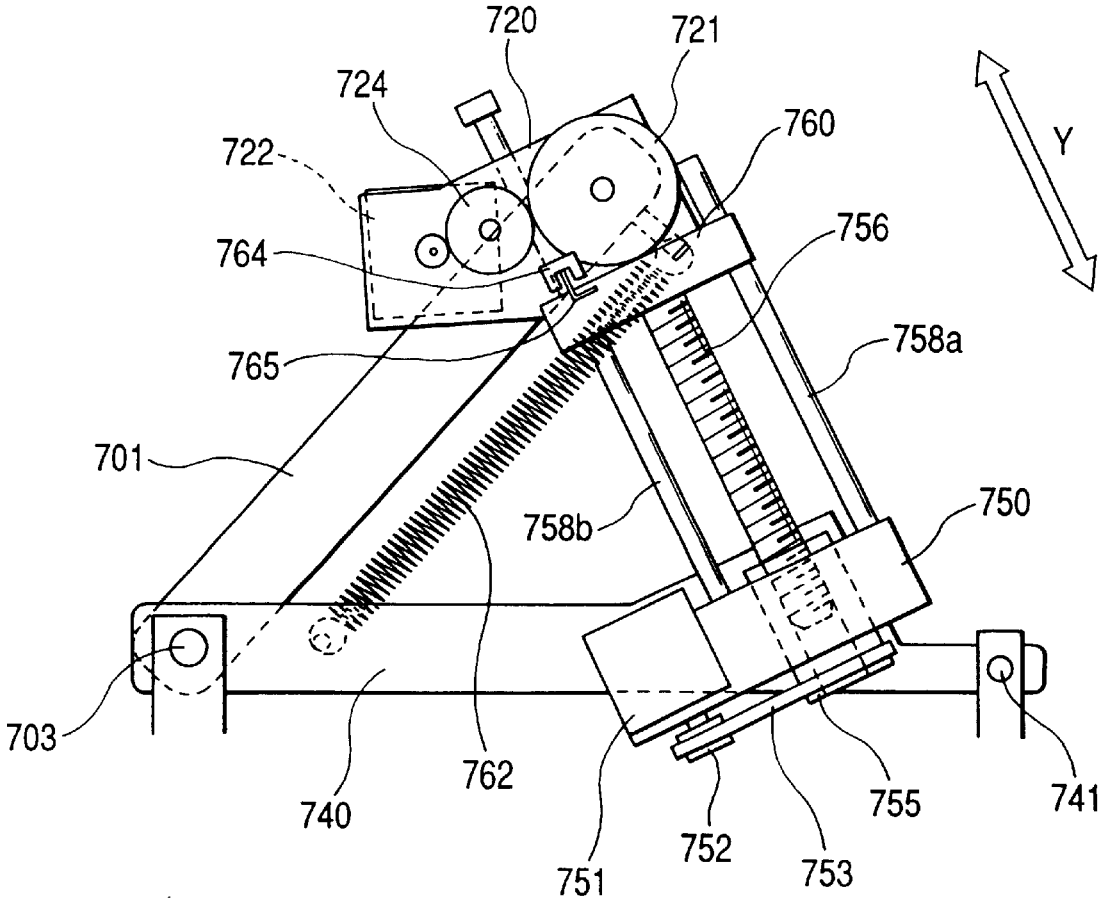
FIG. 4 is a view, taken from the direction of arrow E in FIG. 2, of the carriage section.

Referring to FIGS. 2, 3, and 4, a description will be given of the construction of the carriage section 700. FIG. 3 is a schematic diagram of essential portions of the carriage section 700, and FIG. 4 is a view, taken from the direction of arrow E in FIG. 2, of the carriage section 700.

The carriage 701 is capable of rotating the lens LE while chucking it with two lens chuck shafts (lens rotating shafts) 702L and 702R, and is rotatably slidable with respect to a carriage shaft 703 that is fixed to the base 10 and that extends in parallel to the abrasive-wheel rotating shaft 601. Hereafter, a description will be given of a lens chuck mechanism and a lens rotating mechanism as well as an X-axis moving mechanism and a Y-axis moving mechanism of the carriage 701 by assuming that the direction in which the carriage 701 is moved in parallel to the abrasive-wheel rotating shaft 601 is the X axis, and the direction for changing the axis-to-axis distance between the chuck shafts (702L, 702R) and the abrasive-wheel rotating shaft 601 by the rotation of the carriage 701 is the Y axis.

Lens Chuck Mechanism and Lens Rotating Mechanism

The chuck shaft 702L and the chuck shaft 702R are rotatably held coaxially by a left arm 701L and a right arm 701R, respectively, of the carriage 701. A chucking motor 710 is fixed to the center of the upper surface of the right arm 701R, and the rotation of a pulley 711 attached to a rotating shaft of the motor 710 rotates a feed screw 713, which is rotatably held inside the right arm 701R, by means of a belt 712. A feed nut 714 is moved in the axial direction by the rotation of the feed screw 713. As a result, the chuck shaft 702R connected to the feed nut 714 can be moved in the axis direction, so that the lens LE is clamped by the chuck shafts 702L and 702R.

A rotable block 720 for attaching a motor, which is rotatable about the axis of the chuck shaft 702L, is attached to a left-side end portion of the left arm 701L, and the chuck shaft 702L is passed through the block 720, a gear 721 being secured to the left end of the chuck shaft 702L. A motor 722 for lens rotation is fixed to the block 720, and as the motor 722 rotates the gear 721 through a gear 724, the rotation of the motor 720 is transmitted to the chuck shaft 702L. A pulley 726 is attached to the chuck shaft 702L inside the left arm 701L. The pulley 726 is linked by means of a timing belt 731*a* to a pulley 703*a* secured to a left end of a rotating shaft 728, which is held rotatably in the rear of the carriage 701. Further, a pulley 703*b* secured to a right end of the rotating shaft 728 is linked by means of a timing belt 731*b* to a pulley 733 which is attached to the chuck shaft 702R in such a manner as to be slideable in the axial direction of the chuck shaft 702R inside the right arm 701R. By virtue of this arrangement, the chuck shaft 702L and the chuck shaft 702R are rotated synchronously.

X-axis Moving Mechanism and Y-axis Moving Mechanism of Carriage

The carriage shaft 703 is provided with a movable arm 740 which is slidable in its axial direction so that the arm 740 is movable in the X-axis direction (in the axial direction of the shaft 703) together with the carriage 701. Further, the arm 740 at its front position is slidable on and along a guide shaft 741 that is secured to the base 10 in a parallel positional relation to the shaft 703. A rack 743 extending in parallel to the shaft 703 is attached to a rear portion of the arm 740, and this rack 743 meshes with a pinion 746 attached to a rotating shaft of a motor 745 for moving the carriage in the X-axis direction, the motor 745 being secured to the base 10. By virtue of the above-described arrangement, the motor 745 is able to move the carriage 701 together with the arm 740 in the axial direction of the shaft 703 (in the X-axis direction).

As shown in FIG. 3(*b*), a swingable block 750 is attached to the arm 740 in such a manner as to be rotatable about the axis La which is in alignment with the rotational center of the abrasive wheels 602. The distance from the center of the shaft 703 to the axis La and the distance from the center of the shaft 703 to the rotational center of the chuck shaft (702L, 702R) are set to be identical. A Y-axis moving motor 751 is attached to the swingable block 750, and the rotation of the motor 751 is transmitted by means of a pulley 752 and a belt 753 to a female screw 755 held rotatably in the swingable block 750. A feed screw 756 is inserted in a threaded portion of the female screw 755 in mesh therewith, and the feed screw 756 is moved vertically by the rotation of the female screw 755.

A guide block 760 which abuts against a lower end surface of the motor-attaching block 720 is fixed to an upper end of the feed screw 756, and the guide block 760 moves along two guide shafts 758*a* and 758*b* implanted on the swingable block 750. Accordingly, as the guide block 760 is vertically moved together with the feed screw 756 by the rotation of the motor 751, it is possible to change the vertical position of the block 720 abutting against the guide block 760. As a result, the vertical position of the carriage 701 attached to the block 720 can be also changed (namely, the carriage 701 rotates about the shaft 703 to change the axis-to-axis distance between the chuck shafts (702L, 702R) and the abrasive-wheel rotating shaft 601). A spring 762 is stretched between the left arm 701L and the arm 740, so that the carriage 701 is constantly urged downward to impart processing pressure onto the leans LE. Although the downward urging force acts on the carriage 701, the downward movement of the carriage 701 is restricted such that the carriage 701 can only be lowered down to the position in which the block 720 abuts against the guide block 760. A sensor 764 for detecting an end of processing is attached to the block 720, and the sensor 764 detects the end of processing (ground state) by detecting the position of a sensor plate 765 attached to the guide block 760.

(B) Lens-Shape Measuring Section

Figure 5:
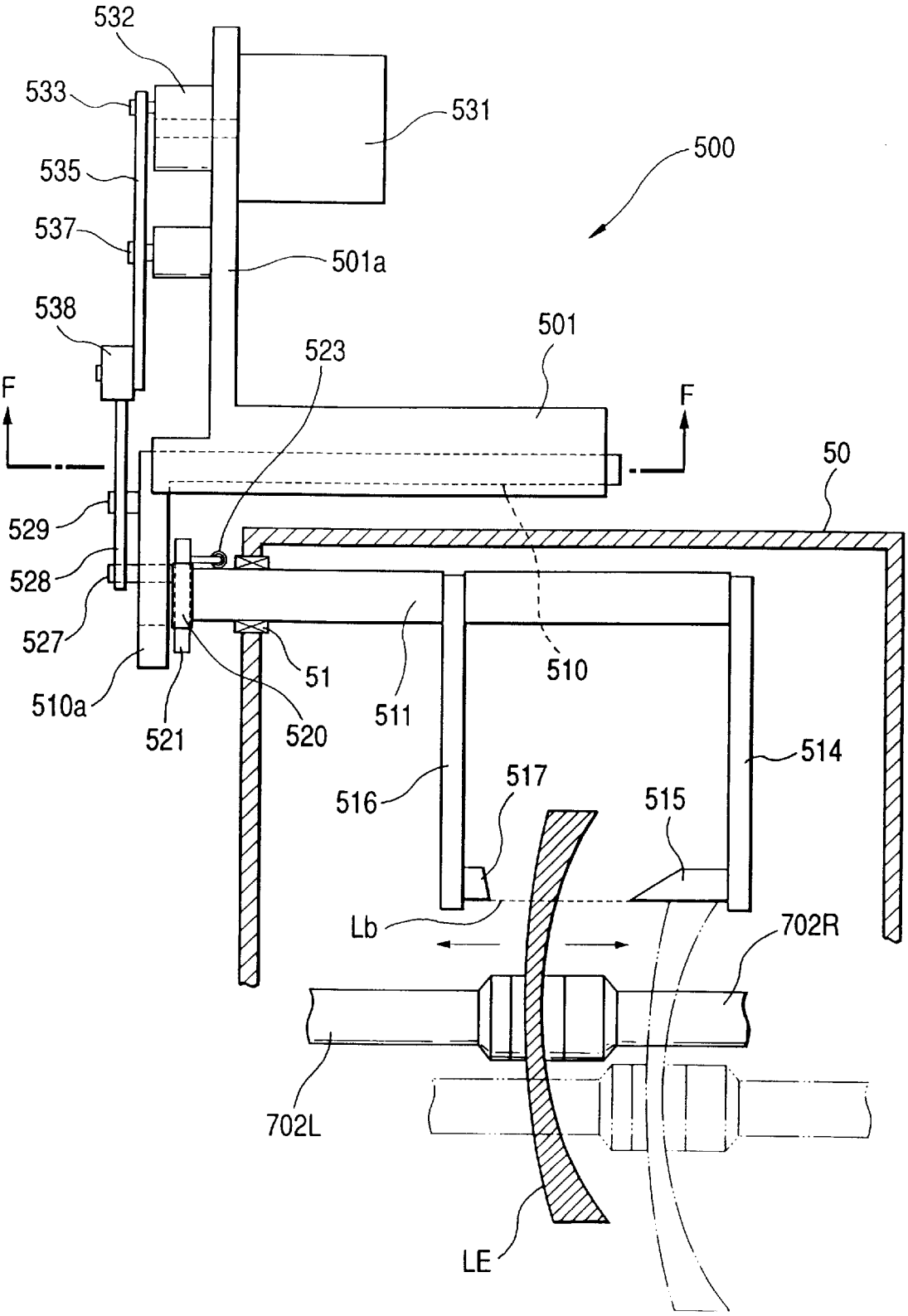
FIG. 5 is a top view of a lens-shape measuring section.
Figure 6:
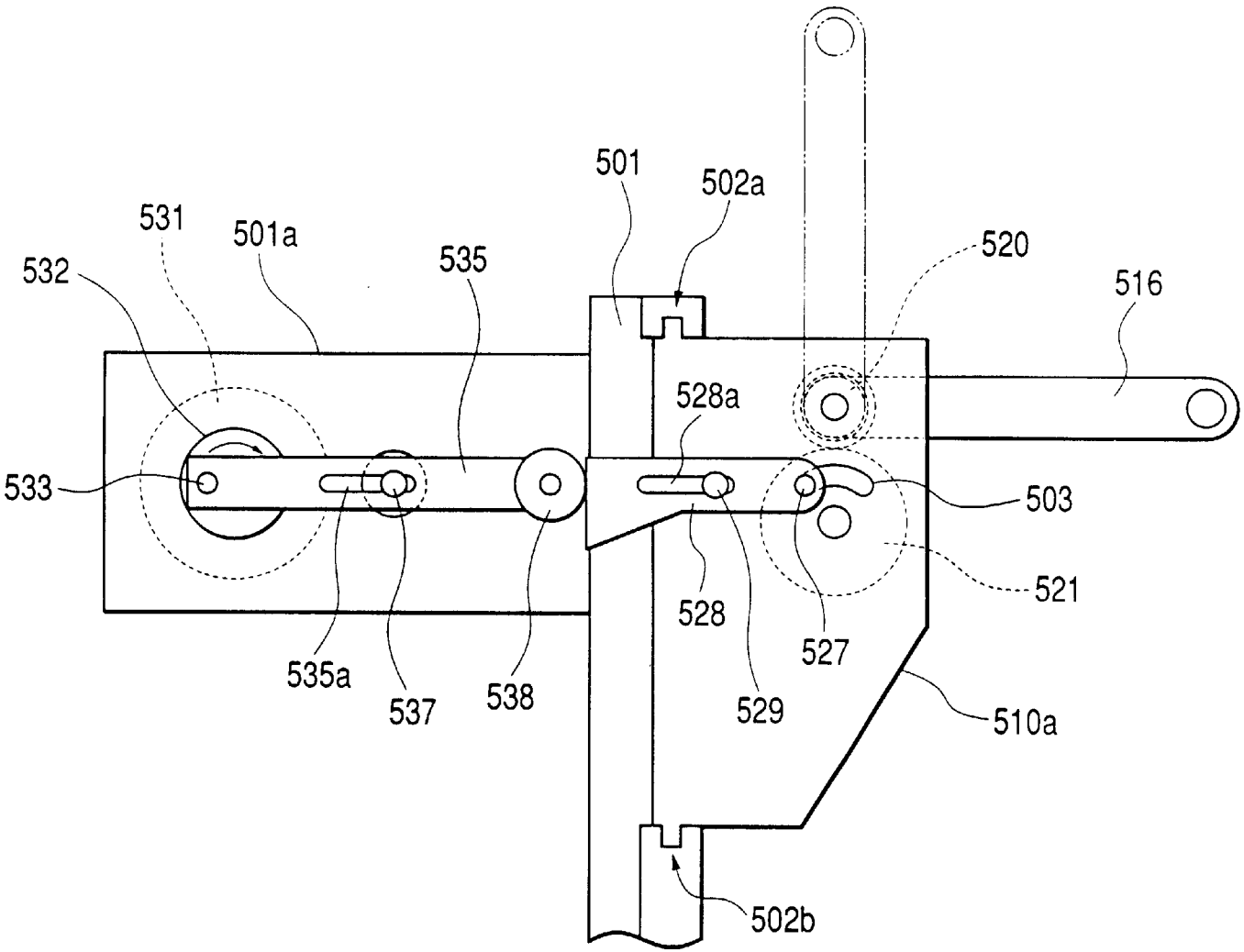
FIG. 6 is a left side elevational view of FIG. 5.
Figure 7:
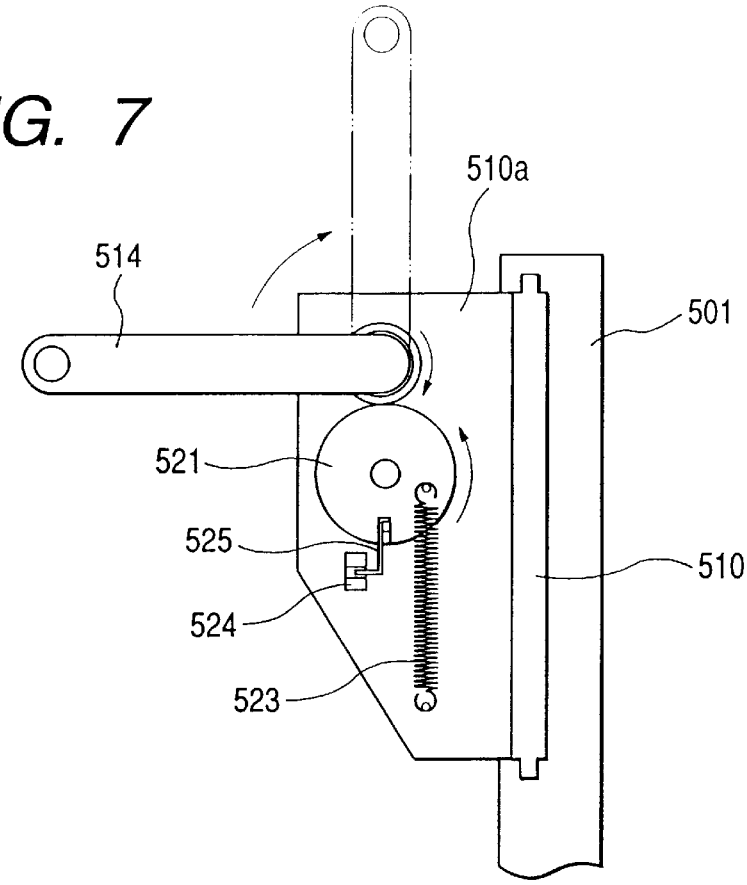
FIG. 7 is a view illustrating essential portions of the right side surface shown in FIG. 5.
Figure 8:
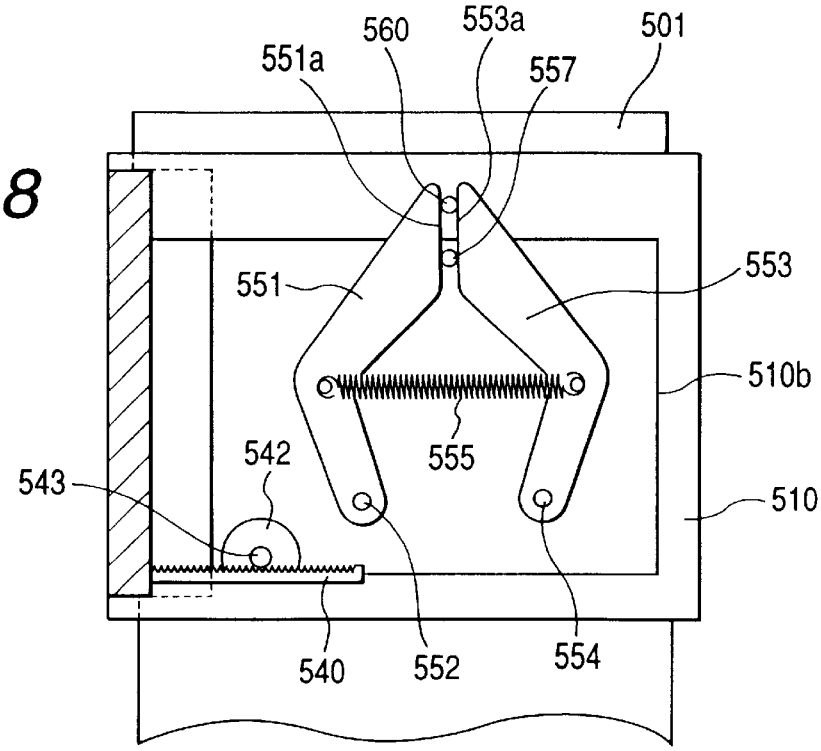
FIG. 8 is a cross-sectional view taken along line F—F in FIG. 5.

Referring to FIGS. 5 to 8, a description will be given of the construction of the lens-shape measuring section 500. FIG. 5 is a top view of the lens-shape measuring section, FIG. 6 is a left side elevational view of FIG. 5, and FIG. 7 is a view illustrating essential portions of the right side surface shown in FIG. 5. FIG. 8 is a cross-sectional view taken along line F—F in FIG. 5.

A supporting block 501 is provided uprightly on the base 10. A sliding base 510 is held on the supporting block 501 in such a manner as to be slidable in the left-and-right direction (in a direction parallel to the chuck shafts) by means of a pair of upper and lower guide rail portions 502*a* and 502*b*. A forwardly extending side plate 510*a* is formed integrally at a left end of the sliding base 510, and a shaft 511 having a parallel positional relation to the chuck shafts 702L and 702R is rotatably attached to the side plate 510*a*. A feeler arm 514 having a feeler 515 for measuring the lens rear surface is secured to a right end portion of the shaft 511, while a feeler arm 516 having a feeler 517 for measuring the lens front surface is secured to the shaft 511 at a position close to its center. Both the feeler 515 and the feeler 517 have a hollow cylindrical shape, a distal end portion of each of the feelers is obliquely cut as shown in FIG. 5, and the obliquely cut tip comes into contact with the rear surface or front surface of the lens LE. Contact points of the feeler 515 and the feeler 517 are opposed to each other, and the interval therebetween is arranged to be constant. Incidentally, the axis Lb connecting the contact point of the feeler 515 and the contact point of the feeler 517 is in a predetermined parallel positional relation to the axis of the chuck shafts (702L, 702R) in the state measurement shown in FIG. 5. Further, the feeler 515 has a slightly longer hollow cylindrical portion, and measurement is effected by causing its side surface to abut against an edge surface of the lens LE during the measurement of the outside diameter of the lens.

A small gear 520 is fixed to a proximal portion of the shaft 511, and a large gear 521 which is rotatably provided on the side plate 510*a* is in mesh with the small gear 520. A spring 523 is stretched between the large gear 521 and a lower portion of the side plate 510*a*, so that the large gear 521 is constantly pulled in the direction of rotating clockwise in FIG. 7 by the spring 523. Namely, the arms 514 and 516 are urged so as to rotate downward by means of the small gear 520.

A slot 503 is formed in the side plate 510*a*, and a pin 527 which is eccentrically secured to the large gear 521 is passed through the slot 503. A first moving plate 528 for rotating the large gear 521 is attached to the pin 527. An elongated hole

528*a* is formed substantially in the center of the first moving plate 528, and a fixed pin 529 secured to the side plate 510*a* is engaged in the elongated hole 528*a*.

Further, a motor 531 for arm rotation is attached to a rear plate 501*a* extending in the rear of the supporting block 501, and an eccentric pin 533 at a position eccentric from the rotating shaft is attached to a rotating member 532 provided on a rotating shaft of the motor 531. A second moving plate 535 for moving the first moving plate 528 in the back-and-forth direction (in the left-and-right direction in FIG. 6) is attached to the eccentric pin 533. An elongated hole 535*a* is formed substantially in the center of the second moving plate 535, and a fixed pin 537 which is fixed to the rear plate 501*a* is engaged in the elongated hole 535*a*. A roller 538 is rotatably attached to an end portion of the second moving plate 535.

When the eccentric pin 533 is rotated clockwise from the state shown in FIG. 6 by the rotation of the motor 531, the second moving plate 535 moves forward (rightward in FIG. 6) by being guided by the fixed pin 537 and the elongated hole 535*a*. Since the roller 538 abuts against the end face of the first moving plate 528, the roller 538 moves the first moving plate 528 in the forward direction as well owing to the movement of the second moving plate 535. As a result of this movement, the first moving plate 528 rotates the large gear 521 by means of the pin 527. The rotation of the large gear 521, in turn, causes the feeler arm 514 and 516 attached to the shaft 511 to retreat to an upright state. The driving by the motor 531 to this retreated position is determined as an unillustrated micro switch detects the rotated position of the rotating member 532.

If the motor 531 is reversely rotated, the second moving plate 535 is pulled back, the large gear 521 is rotated by being pulled by the spring 523, and the feeler arms 514 and 516 are inclined toward the front side. The rotation of the large gear 521 is limited as the pin 527 comes into contact with an end surface of the slot 503 formed in the side plate 501*a,* thereby determining the measurement positions of the feeler arms 514 and 516. The rotation of the feeler arms 514 and 516 up to this measurement positions is detected as the position of a sensor plate 525 attached to the large gear 521 is detected by a sensor 524 attached to the side plate 510*a,* as shown in FIG. 7.

Figure 9A:
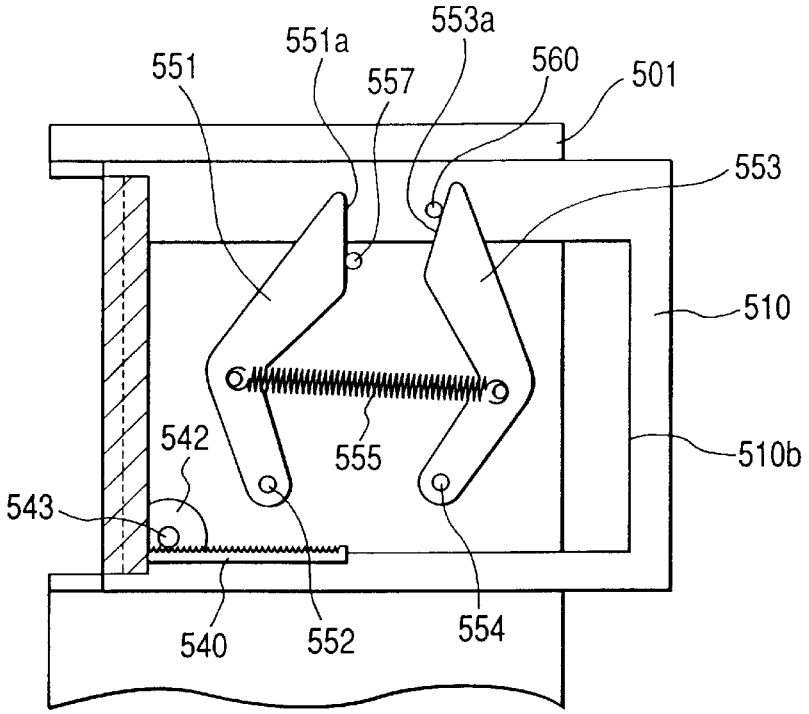
FIGS. 9(*a*) and 9(*b*) are diagrams explaining the state of left-and-right movement of the lens-shape measuring section.
Figure 9B:
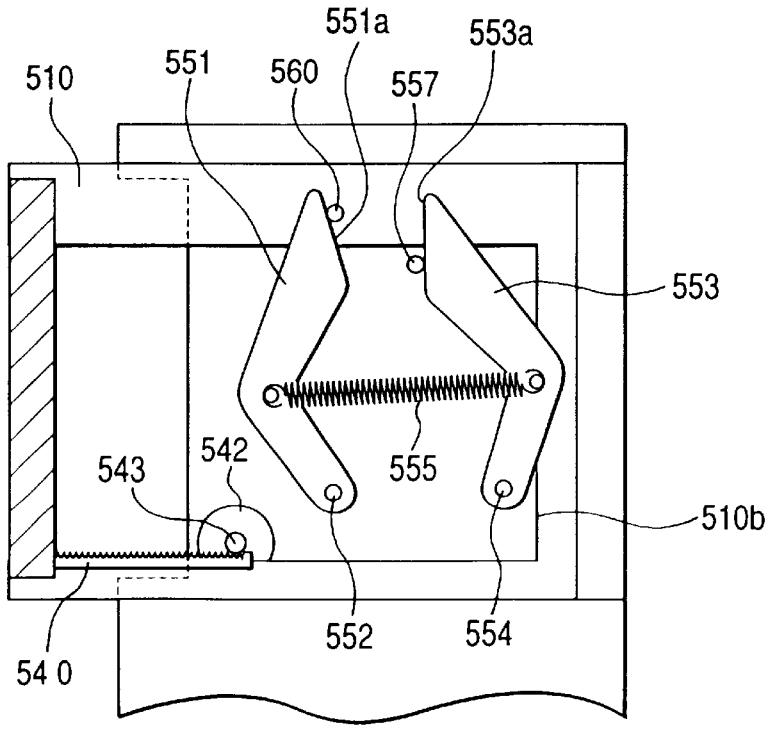

Referring to FIGS. 8 and 9, a description will be given of a left-and-right moving mechanism of the sliding base 510 (feeler arms 514, 515). FIG. 9 is a diagram illustrating the state of left-and-right movement.

An opening 510*b* is formed in the sliding base 510, and a rack 540 is provided at a lower end of the opening 510*b*. The rack 540 meshes with a pinion 543 of an encoder 542 fixed to the supporting block 501, and the encoder 542 detects the direction of the left-and-right movement and the amount of movement of the sliding base 510. A chevron-shaped driving plate 551 and an inverse chevron-shaped driving plate 553 are attached to a wall surface of the supporting block 501, which is exposed through the opening 510*b* in the sliding base 510, in such a manner as to be rotatable about a shaft 552 and a shaft 554, respectively. A spring 555 having urging forces in the directions in which the driving plate 551 and the driving plate 553 approach each other is stretched between the two driving plates 551 and 553. Further, a limiting pin 557 is embedded in the wall surface of the supporting block 501, and when an external force is not acting upon the sliding base 510, both an upper end face 551*a* of the driving plate 551 and an upper end face 553*a* of the driving plate 553 are in a state of abutting against the limiting pin 557, and this limiting pin 557 serves as an origin of the left- and rightward movement.

Meanwhile, a guide pin 560 is secured to an upper portion of the sliding base 510 at a position between the upper end face 551*a* of the driving plate 551 and the upper end face 553*a* of the driving plate 553. When a rightwardly moving force acts upon the sliding base 510, as shown in FIG. 9(*a*), the guide pin 560 abuts against the upper end face 553*a* of the driving plate 553, causing the driving plate 553 to be tilted rightward. At this time, since the driving plate 551 is fixed by the limiting pin 557, the sliding base 510 is urged in the direction of being returned to the origin of left- and rightward movement (in the leftward direction) by the spring 555. On the other hand, when a leftwardly moving force acts upon the sliding base 510, as shown in FIG. 9(*b*), the guide pin 560 abuts against the upper end face 551*a* of the driving plate 551, and the driving plate 551 is tilted leftward, but the driving plate 553 is fixed by the limiting pin 557. Accordingly, the sliding base 510 this time is urged in the direction of being returned to the origin of left- and rightward movement (in the rightward direction) by the spring 555. From such movement of the sliding base 510, the amount of movement of the feeler 515 in contact with the lens rear surface and the feeler 517 in contact with the lens front surface (the amount of axial movement of the chuck shafts) is detected by a single encoder 542.

It should be noted that, in FIG. 5, reference numeral 50 denotes a waterproof cover, and only the shaft 511, the feeler arms 514 and 516, and the feelers 515 and 517 are exposed in the waterproof cover 50. Numeral 51 denotes a sealant for sealing the gap between the waterproof cover 50 and the shaft 511. Although a coolant is jetted out from an unillustrated nozzle during processing, since the lens-shape measuring section 500 is disposed in the rear of the processing chamber and by virtue of the above-described arrangement, it is possible to provide waterproofing for the electrical components and moving mechanism of the lens-shape measuring section 500 by merely providing shielding for the shaft 511 exposed in the waterproof cover 50, and the waterproofing structure is thus simplified.

(C) Chamfering and Grooving Mechanism Section

Figure 10:
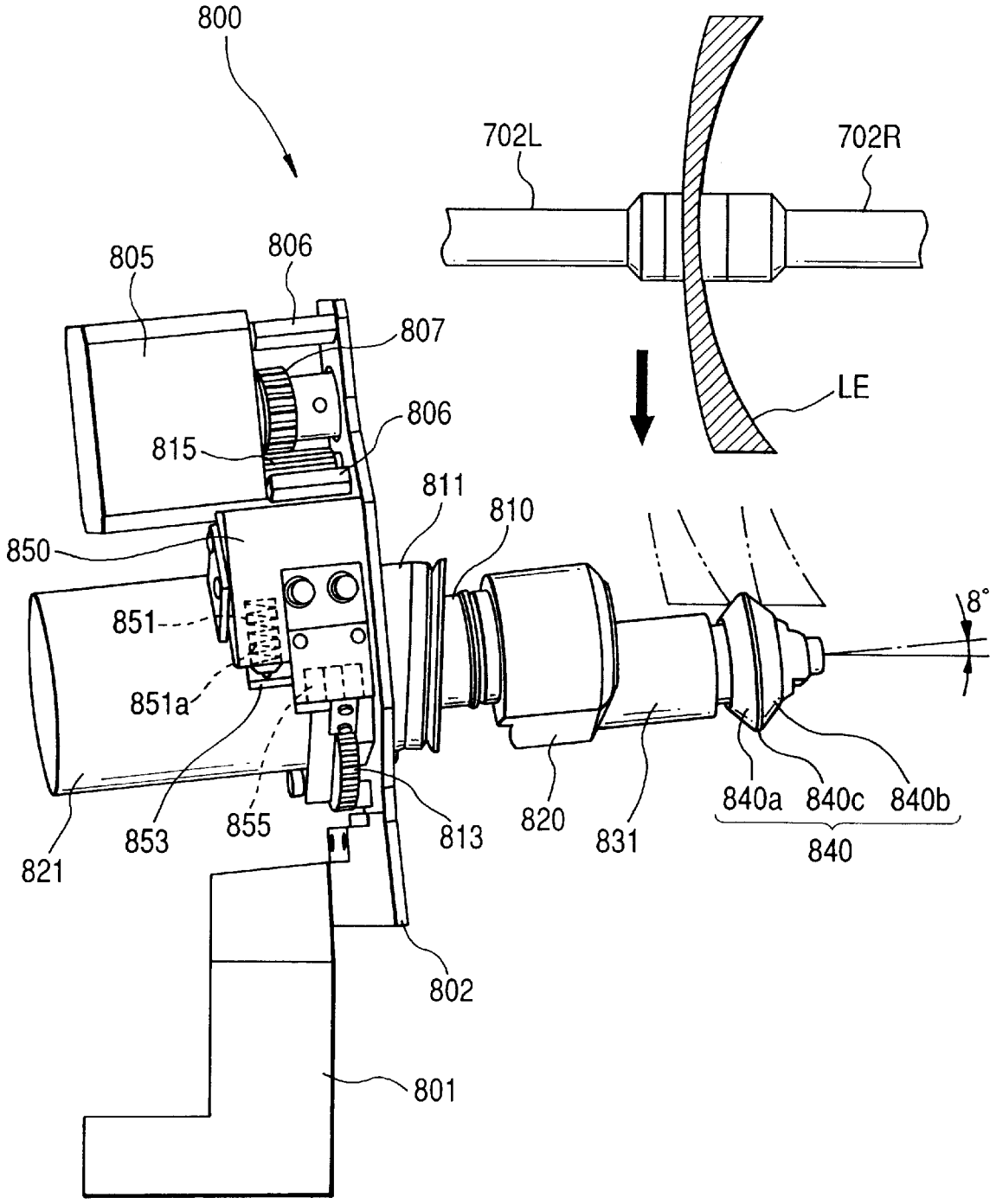
FIG. 10 is a front elevational view of a chamfering and grooving mechanism section.
Figure 11:
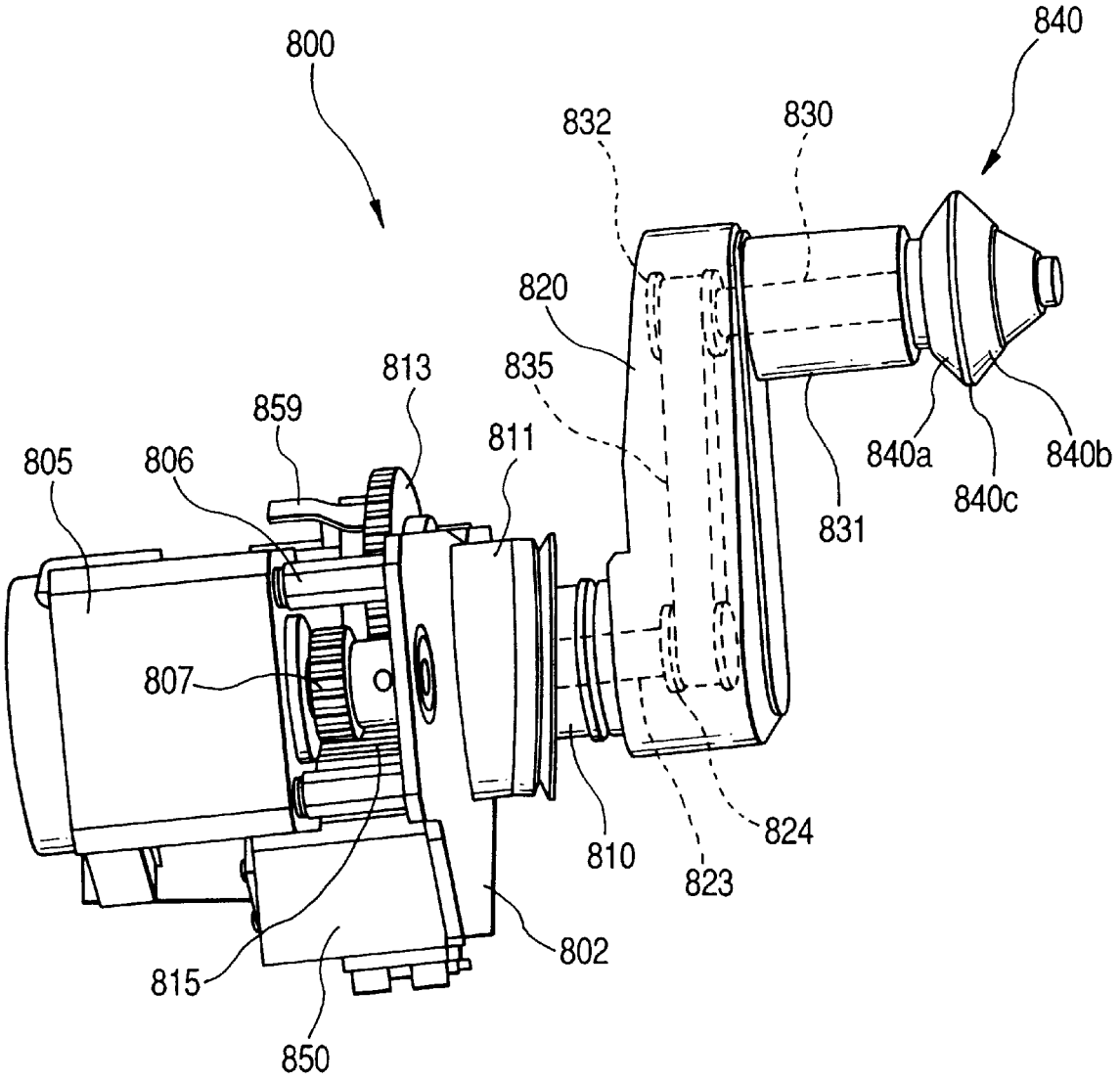
FIG. 11 is a top plan view of the chamfering and grooving mechanism section.
Figure 12:
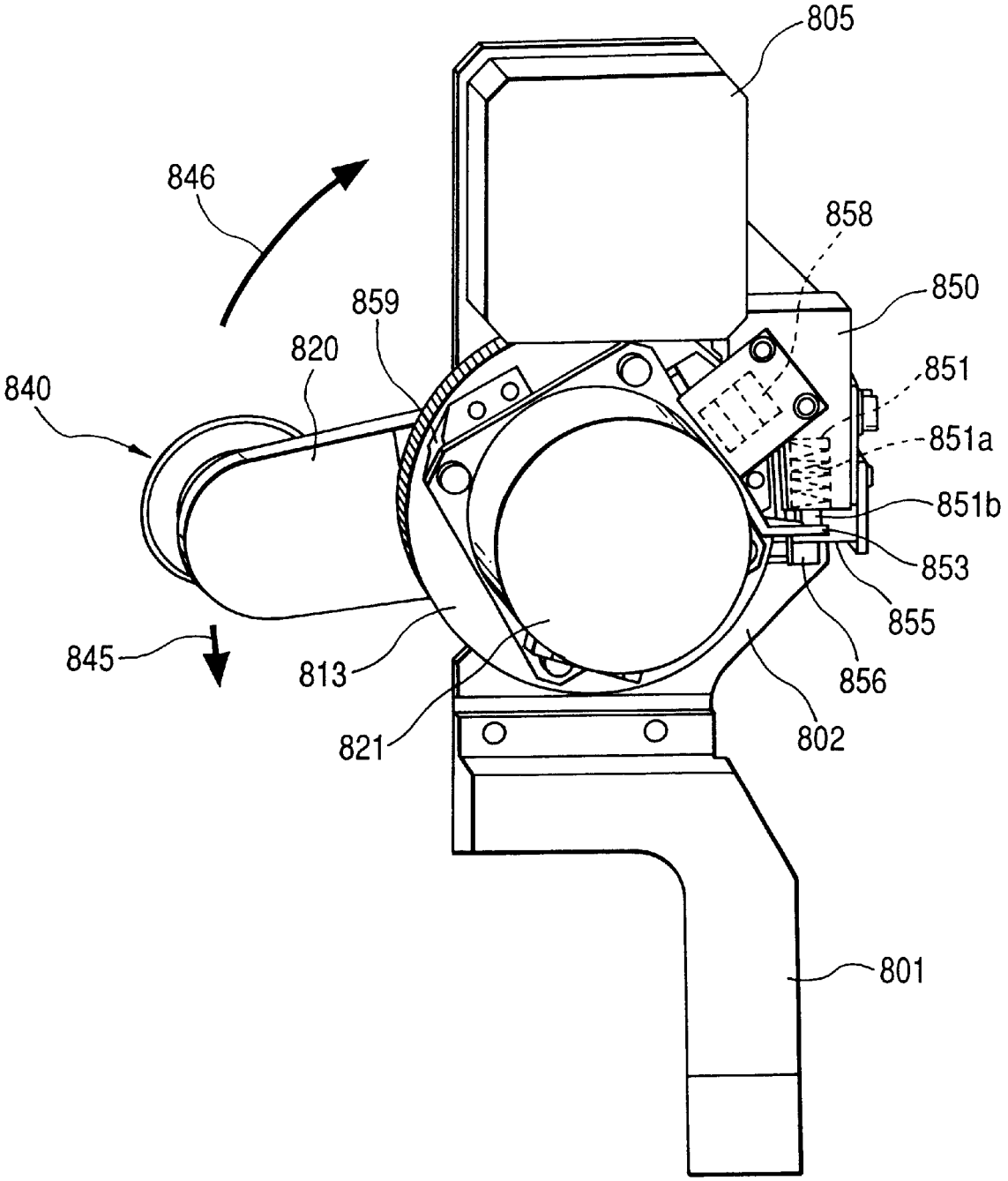
FIG. 12 is a left side elevational view of the chamfering and grooving mechanism section.

Referring to FIGS. 10 to 12, a description will be given of the construction of the chamfering and grooving mechanism section 800. FIG. 10 is a front elevational view of the chamfering and grooving mechanism section 800; FIG. 11 is a top view; and FIG. 12 is a left side elevational view.

A fixed plate 802 for attaching the various members is fixed to a supporting block 801 fixed to the base 10. A pulse motor 805 for rotating an arm 820 (which will be described later) to move an abrasive wheel section 840 to a processing position and a retreated position is fixed on an upper left-hand side of the fixed plate 802 by four column spacers 806. A holding member 811 for rotatably holding an arm rotating member 810 is attached to a central portion of the fixed plate 802, and a large gear 813 is secured to the arm rotating member 810 extending to the left-hand side of the fixed plate 802. A gear 807 is attached to a rotating shaft of the motor 805, and the rotation of the gear 807 by the motor 805 is transmitted to the large gear 813 through an idler gear 815, thereby rotating the arm 820 attached to the arm rotating member 810.

In addition, an abrasive-wheel rotating motor 821 is secured to a rear (left-hand side in FIG. 10) of the large gear 813, and the motor 821 rotates together with the large gear 813. A rotating shaft of the motor 821 is connected to a shaft 823 which is rotatably held inside the arm rotating member 810, and a pulley 824 is attached to the other end of the shaft 823 extending to the interior of the arm 820. Further, a holding member 831 for rotatably holding an abrasive-wheel rotating shaft 830 is attached to a distal end of the arm 820, and a pulley 832 is attached to a left end (left-hand side in FIG. 11) of the abrasive-wheel rotating shaft 830. The pulley 832 is connected to the pulley 824 by a belt 835, so that the rotation of the motor 821 is transmitted to the abrasive-wheel rotating shaft 830.

The abrasive wheel section 840 is mounted on a right end of the abrasive-wheel rotating shaft 830. The abrasive wheel section 840 is so constructed that a chamfering abrasive wheel 840*a* for a lens rear surface, a chamfering abrasive wheel 840*b* for a lens front surface, and a grooving abrasive wheel 840*c* provided between the two chamfering abrasive wheels 840*a* and 840*b* are integrally formed. The diameter of the grooving abrasive wheel 840*c* is about 30 mm, and the chamfering abrasive wheels 840*a* and 840*b* on both sides have processing slanting surfaces such that their diameters become gradually smaller toward their outward sides with the grooving abrasive wheel 840*c* as the center.

It should be noted that the abrasive-wheel rotating shaft 830 is disposed in such a manner as to be inclined about 8 degrees with respect to the axial direction of the chuck shafts 702L and 702R, so that the groove can be easily formed along the lens curve by the grooving abrasive wheel 840*c*. Additionally, the slanting surface of the chamfering abrasive wheel 840*a* and the slanting surface of the chamfering abrasive wheel 840*b* are so designed that the chamfering angles for the edge corners of the lens LE chucked by the chuck shafts 702L and 702R are respectively set to 55 degrees and 40 degrees.

A block 850 is attached to this side on the left-hand side (this side on the left-hand side in FIG. 10) of the fixed plate 802, and a ball plunger 851 having a spring 851*a* is provided inside the block 850. Further, a limiting plate 853 which is brought into contact with a ball 851*b* of the ball plunger 851 is fixed to the large gear 813. At the time of starting the grooving and chamfering, the arm 820 is rotated together with the large gear 813 by the rotation of the motor 805, so that the abrasive wheel section 840 is placed at the processing position shown in FIG. 12. At this time, the limiting plate 853 is brought to a position for abutment against the ball 851*b*. Since the grooving and chamfering are effected while the lens LE is being pressed against the abrasive wheel section 840, the abrasive wheel section 840 is pressed down in the direction of arrow 845 in FIG. 12, and the large gear 813 rotates. Since this rotation causes the limiting plate 853 to compress the spring 851*a* by means of the ball 851*b*, an urging force acting in the direction toward the lens LE (in a direction for returning to the processing position) is applied to the abrasive wheel section 840. The abrasive wheel section 840 is capable of running off to the position where the ball 851*b* is pressed in, and the run-off distance is set to about 5 mm.

In FIG. 12, a sensor 855 for detecting the origin of the processing position is fixed below the block 850. As the sensor 855 detects the light-shielded state of a sensor plate 856 attached to the large gear 813 so as to detect the origin of the processing position of the abrasive wheel section 840, i.e., the position where the limiting plate 853 abuts against the ball 851*b* without application of the urging force due to the ball plunger 851.

Further, a sensor 858 for detecting the retreated position is fixed on an upper side of the block 850. As the sensor 858 detects a sensor plate 859 attached to the large gear 813, the sensor 858 detects the retreated position of the abrasive wheel section 840 which is rotated together with the arm 820 in the direction of arrow 846. The retreated position of the abrasive wheel section 840 is set at a position offset rightwardly from a vertical direction in FIG. 12.

It should be noted that, in applying a fixed load between the lens and the chamfering abrasive wheel, it is conceivable to adopt an arrangement in which the position of the chamfering abrasive wheel is fixed during processing and a load is imparted by a spring provided on the carriage mechanism. However, the spring on the carriage mechanism side imparts an excessively large load, and is therefore unsuitable for the chamfering of a small amount which is called thread or fine chamfering. Even if adjustment is made to make the load small, since the carriage mechanism has weight, the motion during its movement is poor, so that the control of the amount of chamfering becomes extremely difficult. In contrast, in accordance with this embodiment, the control of the amount of chamfering can be facilitated by applying a fixed load to the lens from the chamfering abrasive wheel side which is lightweight.

Figure 13:
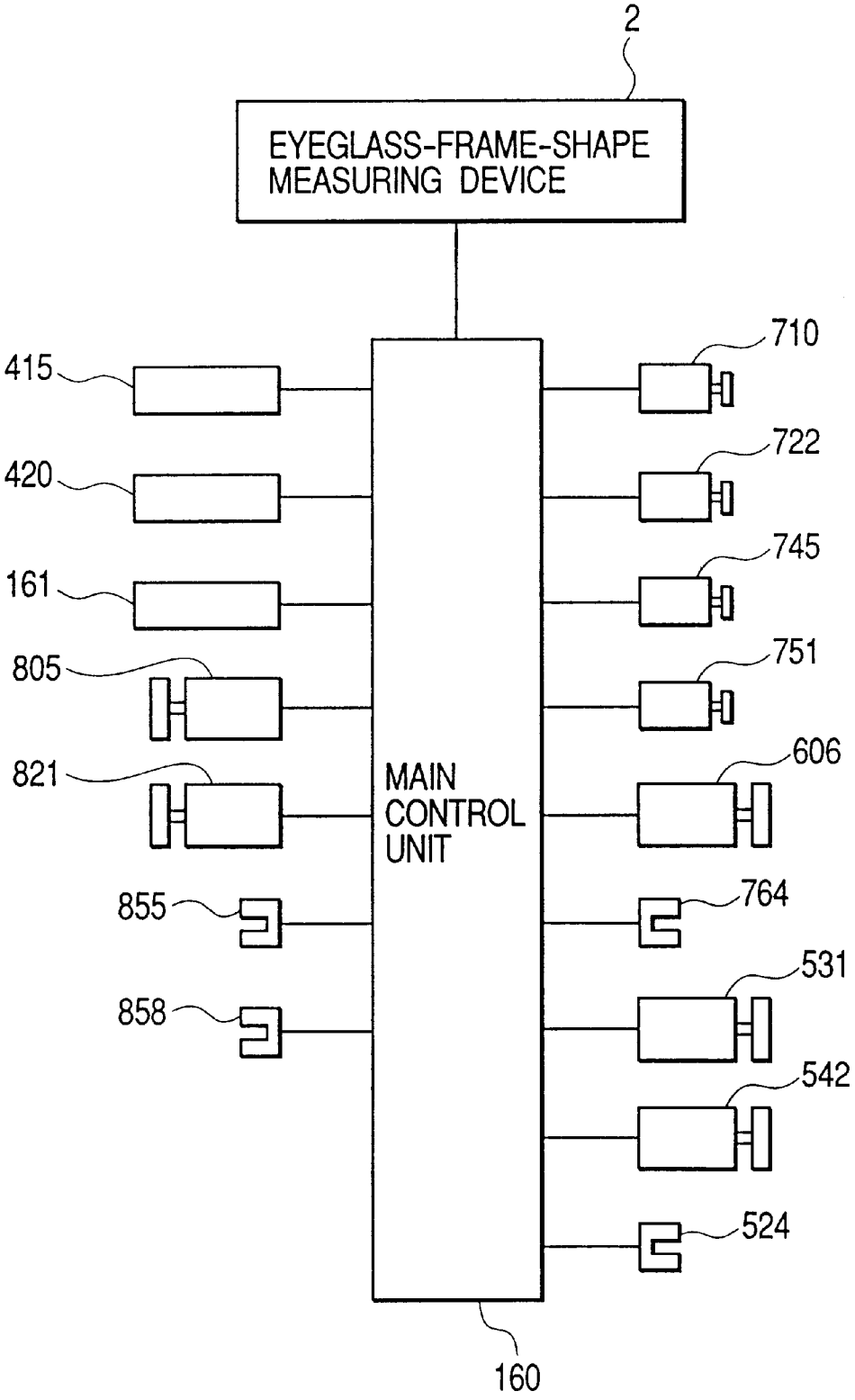
FIG. 13 a block diagram of a control system of the apparatus.

Next, referring to the control block diagram shown in FIG. 13, a description will be given of the operation of the apparatus having the above-described construction. Here, a description will be given of the case in which grooving processing and chamfering processing are performed.

The shape of an eyeglass frame (or template) for fitting the lens is measured by the frame-shape measuring device 2, and the measured target lens shape data is inputted to a data memory 161 by pressing a switch 421. The target lens shape based on the target lens shape data is graphically displayed on the display 415, under which condition the processing conditions can be inputted. By operating switches on the switch panel section 410, the operator inputs necessary layout data such as the PD of the wearer, the height of the optical center, and the like. Further, the operator inputs the material of the lens to be processed and the processing mode. In the case where grooving processing is to be effected, the mode for grooving processing is selected by a switch 423 for processing-mode selection. In the case where chamfering is to be effected, a switch 425 is operated to select the chamfering mode. With switch 425, it is possible to select whether or not chamfering is to be effected and the amount of chamfering. Each time the switch 425 is pressed, the mode displayed on the display 415 is consecutively changed over in the order of "no chamfering," "small chamfering," "medium chamfering, and "large chamfering." For example, "small chamfering" is set to effect chamfering of 0.1 mm, "medium chamfering" chamfering of 0.2 mm, and "large chamfering" chamfering of 0.3 mm.

Upon completion of the necessary entry, the lens LE is chucked by the chuck shaft 702L and the chuck shaft 702R, and the start switch 423 is then pressed to operate the apparatus. On the basis of the inputted target lens shape data and layout data, a main control unit 160 obtains radius vector information ($r\delta n$, $r\theta n$) ($n=1, 2, \ldots, N$) with the processing center as the center, determines processing correction information from positional information on a contact point where the radius vector abuts against the abrasive wheel surface (refer to Re. 35,898 (U.S. Pat. No. 5,347,762)), and stores it in the memory 161.

Subsequently, a main control unit 160 executes the lens shape measurement by using the lens-shape measuring section 500 in accordance with a processing sequence program. The main control unit 160 drives the motor 531 to rotate the shaft 511, causing the feeler arms 514 and 516 to be positioned to the measuring position from the retreated position. On the basis of the radius vector data ($r\sigma n$, $r\theta n$), the main control unit 160 vertically moves the carriage 701 so as to change the distance between the axis of the chuck shafts (702L, 702R) and the axis Lb connecting the feeler 515 and the feeler 517, and causes the chucked lens LE to be located between the feeler 515 and the feeler 517, as shown in FIG. 5. Subsequently, the carriage 701 is moved by a predetermined amount toward the feeler 517 side by driving the motor 745 so as to cause the feeler 517 to abut against the front-side refracting surface of the lens LE. The initial measuring position of the lens LE on the feeler 517 side is at a substantially intermediate position in the leftward moving range of the sliding base 510, and a force is constantly applied to the feeler 517 by the spring 555 such that the feeler 517 abuts against the front-side refracting surface of the lens LE.

In the state in which the feeler 517 abuts against the front-side refracting surface, the lens LE is rotated by the motor 722, and the carriage 701 is vertically moved by driving the motor 751 on the basis of the radius vector information, i.e. the processing shape data. In conjunction with such rotation and movement of the lens LE, the feeler 517 moves in the left-and-right direction along the shape of the lens front surface. The amount of this movement is detected by the encoder 542, and the shape of the front-side refracting surface of the lens LE (the path of the front-side edge position) is measured.

Upon completion of the front side of the lens LE, the main control unit 160 rightwardly moves the carriage 701 as it is, and causes the feeler 515 to abut against the rear-side refracting surface of the lens LE to change over the measuring surface. The initial measuring position of rear-side measurement is similarly at a substantially intermediate position in the rightward moving range of the sliding base 510, and a force is constantly applied to the feeler 515 such that the feeler 515 abuts against the rear-side refracting surface of the lens LE. Subsequently, while causing the lens LE to undergo one revolution, the shape of the rear-side refracting surface (the path of the rear-side edge position) is measured from the amount of movement of the feeler 515 in the same way as in the measurement of the front-side refracting surface. When the shape of the front-side refracting surface and the shape of the rear-side refracting surface of the lens can be obtained, edge thickness information can be obtained from the two items of the information. After completion of the lens shape measurement, the main control unit 160 drives the motor 531 to retreat the feeler arms 514 and 516.

Upon completion of the measurement of the lens shape, the main control unit 160 executes the processing of the lens LE in accordance with the input data of the processing conditions. In a case where the lens LE is a plastic, the main control unit 160 moves the carriage 701 by means of the motor 745 so that the lens LE is brought over the rough abrasive wheel 602*b*, and vertically moves the carriage 701 on the basis of the processing correction information to perform rough processing. Next, the lens LE is moved to the planar portion of the finishing abrasive wheel 602*c*, and the carriage 701 is vertically moved in the similar fashion to perform finish processing.

Upon completion of finish processing, the operation then proceeds to grooving processing by the chamfering and grooving mechanism section 800. After raising the carriage 701, the main control unit 160 rotates the motor 805 a predetermined number of pulses so that the abrasive wheel section 840 placed at the retreated position comes to the processing position. Subsequently, as the carriage 701 is moved vertically and in the axial direction of the chuck shaft, the lens LE is positioned on the grooving abrasive wheel 840*c* which is rotated by the motor 821, and processing is effected by controlling the movement of the carriage 701 on the basis of grooving processing data.

The grooving processing data is determined in advance by the main control unit 160 from the radius vector information and the measured results of the lens shape. The data for vertically moving the carriage 701 is obtained by first determining the distance between the abrasive wheel 840*c* and the lens chuck shaft relative to the angle of lens rotation from the estimated radius vector information (r σ n, r θ n) and the diameter of the abrasive wheel 840*c* in the same way as for the group of abrasive wheels 602, and then by incorporating information on the groove depth into it. In addition, as for the data on the groove position in the axial position of the chuck shaft, since the edge thickness can be known from the shape of the front-side refracting surface and the shape of the rear-side refracting surface based on the measured data on the lens shape, the data on the groove position in the axial position of the chuck shaft can be determined on the basis of this edge thickness in a procedure similar to that for determining the beveling position. For example, in addition to a method in which the lens edge thickness is determined at a certain ratio, it is possible to adopt various methods including one in which the groove position is offset by a fixed amount from the edge position of the lens front surface toward the rear surface, and is made to extend along the front surface curve.

The grooving processing is effected while the lens LE is being caused to abut against the abrasive wheel 840*c* by the vertical movement of the carriage 701. During the processing, the abrasive wheel 840*c* escapes from the origin of the processing position in the direction of arrow 845 in FIG. 12, but since a load is being applied to the abrasive wheel section 840 by the ball plunger 851, the lens LE is gradually ground. Whether or not the grooving processing has been effected down to a predetermined depth is monitored by the sensor 858, and the lens rotation is carried out until the completion of the processing of the entire periphery is detected.

Upon completion of the grooving processing, the main control unit 160 effects chamfering by controlling the movement of the carriage on the basis of the chamfering data.

A description will be given of the calculation of the processing data at the time of chamfering. When chamfering is provided for the rear surface side and the front surface side of the lens, the respective processing data are calculated. A description will be given herein by citing as an example the case of the rear surface side of the lens.

A maximum value of L is determined by substituting the radius vector information (r σ n, r θ n) (n=1, 2, . . . , N) into the formula given below. R represents the radius of the chamfering abrasive wheel 840*a* at the position where an edge of the rear surface of the lens abuts (e.g., an intermediate position of the abrasive wheel surface), and L represents the distance between the center of rotation of the abrasive wheel and the processing center of the lens.

$$L = r\,\sigma\,n \cdot \cos r\,\theta\,n + [R^2 - (r\,\sigma\,n \cdot \sin r\,\theta\,n)^2]^{1/2} \quad (n=1, 2, 3, \ldots, N) \qquad \text{[Formula 1]}$$

Next, the radius vector information (r σ n, r θ n) is rotated by a very small arbitrary unit angle about the processing center, and a maximum value of L at that time is determined in the same way as described above. This rotational angle is set as ξi (i=1, 2, . . . , N). By performing this calculation over the entire periphery, chamfering correction information in the radius vector direction can be obtained as (ξi, Li, Θi) in which a maximum value of L at the respective ξi is set as Li, and rθn at that time is set as Θi.

In addition, processing information in the direction of the axis of the chuck shaft in the chamfering of the rear surface side of the lens is obtained by transforming the information on the lens rear surface shape obtained by the lens shape measurement into a relationship with the rotational angle ξi.

Figure 14:
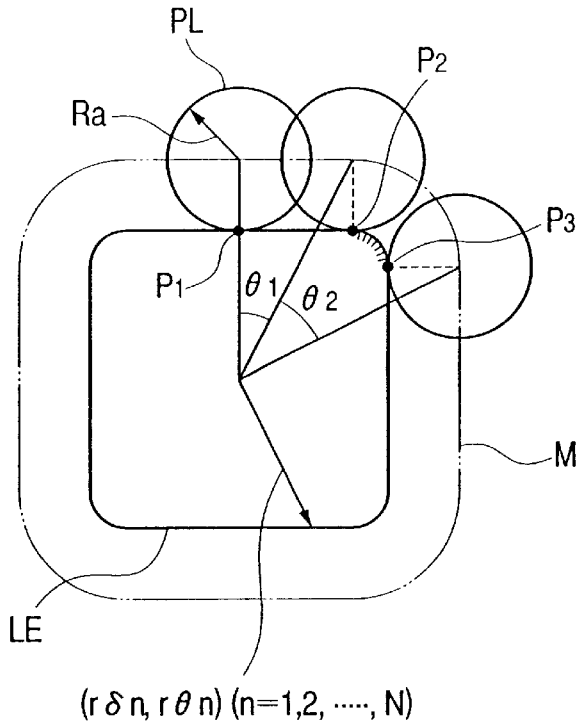
FIG. 14 is a diagram illustrating the relationship of the moving distance of a point of contact between the lens and an abrasive wheel with respect to the rotation of the lens.

Here, if the angular velocity of rotation of the lens during chamfering is fixed, the moving velocity at the point of contact between the lens and the chamfering abrasive wheel varies depending on the lens shape, and uniform chamfering is difficult. For example, when the lens LE is processed by a chamfering abrasive wheel PL having a radius Ra as shown in FIG. 14, the locus of relative movement of the center of the abrasive wheel PL with respect to the lens rotation is shown by the two-dotted dash line. When the distance between P1 and P2 is processed, the lens LE rotates by θ1, and when an acute portion between P2 and P3 is processed, the lens LE rotates by θ2. At this time, although θ2 is greater than θ1 in terms of the angle of rotation, the processing distance between P2–P3 is much shorter than the processing distance between P1–P2. Namely, if the lens LE is rotated at a fixed speed, the moving velocity of the abrasive wheel PL becomes slower for the distance between P2–P3 than for the distance between P1–P2. In the case of the portion where the moving velocity is slow, the time of contact with the abrasive wheel PL becomes longer correspondingly. Hence, if chamfering is effected by applying a fixed load to the lens LE by the abrasive wheel PL, the load from the abrasive wheel PL is strongly applied to the portion where the contact time is long, with the result that that portion is chamfered by a greater amount.

Figure 15:
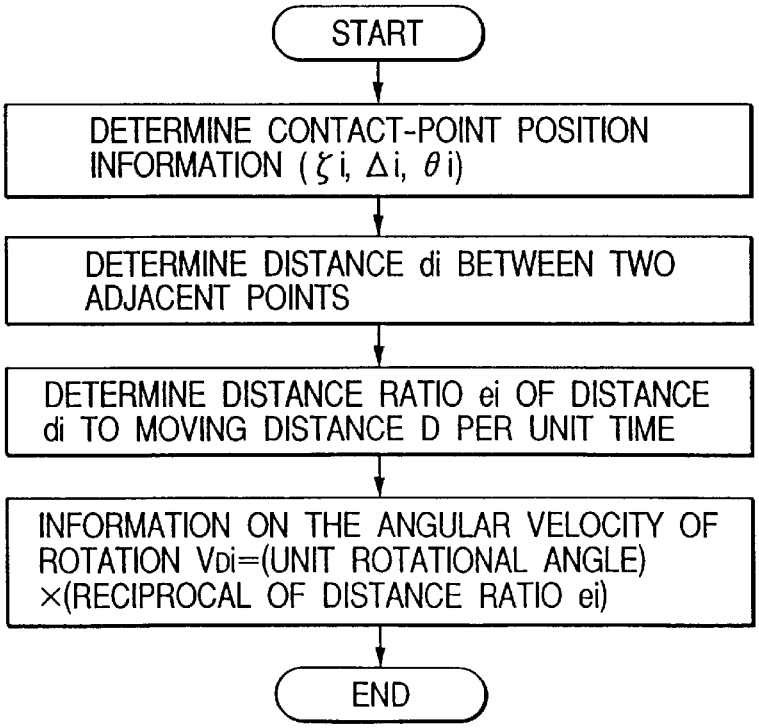
FIG. 15 is a flowchart explaining the calculation of information on the angular velocity of rotation of the lens for rendering substantially constant the moving velocity of the point of contact between the chamfering abrasive wheel and the lens.

Therefore, in the invention, the angular velocity of rotation of the lens is controlled so that the moving velocity of the point of contact between the chamfering abrasive wheel and the lens becomes substantially constant. The data on the angular velocity of rotation is determined by the main control unit 160 in the manner described below (refer to the flowchart in FIG. 15).

In the aforementioned calculation of the chamfering correction information (ξi, Li, Θi), if the radius vector length rδn when the maximum value of L at a unit rotational angle ξi is Li is assumed to be Δi, contact-point position information is obtained as (ξi, Δi, Θi) (i=1, 2, . . . , N). Next, the distance di between two adjacent points at ξi and ξ(i+1) is consecutively determined (this distance can be determined by a transformation into orthogonal coordinates). Then, the distance ratio ei of the distance di to the moving distance D per unit time, which is the moving velocity of the contact point, is consecutively determined. Subsequently, by multiplying the difference between ξi and ξ(i+1) (i.e., unit rotational angle) by the reciprocal of the distance ratio ei, it is possible to obtain information on the angular velocity of rotation per unit rotational angle $V_D$i (i=1, 2, . . . , N) for rendering the moving velocity between the respective two points constant. It should be noted that although the angular velocity of rotation $V_D$i may be determined finely for each distance between the two adjacent contact points, the angular velocity of rotation $V_D$i may be determined upon reducing the number of contact points to some extent.

During chamfering, the main control unit 160 controls the vertical movement of the carriage 701 on the basis of the chamfering correction information (ξi, Li, Θi), and controls the left-and-right movement of the chuck shaft on the basis of the information on the lens rear surface with respect to the rotational angle ξi. Further, the main control unit 160 controls the rotating speed of the lens by the motor 722 on the basis of the angular velocity of rotation $V_D$i. At this time, since the rear surface corner of the lens LE needs to be pressed against the abrasive wheel 840*a*, the carriage 701 is vertically moved such that the abutment surface of the abrasive wheel 840*a* disposed at the processing position is pressed by an extra amount of 1 mm, for example. Consequently, the abrasive wheel 840*a* escapes in the direction of arrow 845 shown in FIG. 12, and chamfering is performed while applying a fixed load to the corner of the lens edge. When the lens is subjected to one rotation in this state, uniform chamfering is effected over the entire periphery of the lens.

It should be noted that the moving velocity with respect to a desired amount of chamfering is affected by the grain size of the chamfering abrasive wheel and the urging force of the ball plunger 851, the moving velocity may be determined on the basis of results of experiments.

In addition, the amount of chamfering can be controlled by varying the moving velocity of the contact point which is made substantially constant during processing, i.e., the moving distance D of the contact point per unit time. For example, the amount of chamfering during one rotation of the lens LE can be varied by setting the moving velocity such that, by using the moving velocity of small chamfering (0.1 mm) as a reference, the moving velocity during medium chamfering (0.2 mm) is set to ½ of the reference velocity, and the moving velocity during large chamfering (0.3 mm) is set to ⅓ of the reference velocity. Alternatively, the amount of chamfering may be controlled by varying the number of rotation of the lens LE while fixing the moving velocity of the contact point during processing. For example, in a case where an arrangement is provided to allow small chamfering (0.1 mm) to be effected through one rotation of the lens, chamfering is effected by subjecting the lens to two rotations during medium chamfering (0.2 mm) and to three rotations during large chamfering (0.3 mm).

Although a description has been given of the case in which the setting of the amount of chamfering is selected by the switch 425 from predetermined amounts, an arrangement may be provided such that a desired amount can be set through a screen for setting chamfering parameters. In this case, the main control unit 160 selects as a most desirable condition the relationship between the moving velocity of the contact point and the number of rotation of the lens.

As described above, in accordance with the invention, it possible to perform satisfactory chamfering easily irrespective of the degree of expert skill of the operator.

What is claimed is:

1. An eyeglass lens processing apparatus for processing a periphery of an eyeglass lens, comprising:

lens rotating means for holding and rotating the lens;

a chamfering abrasive wheel rotating shaft axially supporting at least one chamfering abrasive wheel and a grooving abrasive wheel coaxially and having a rotational axis different from an axis about which a rough abrasive wheel and a finish abrasive wheel are rotatable, the chamfering abrasive wheel rotating shaft being inclined relative to a rotational axis of the lens rotating means so that the grooving abrasive wheel extends along a curvature of an optical plane of the lens;

moving means for moving the chamfering abrasive wheel between a retreated position and a processing position;

detecting means for obtaining position data of an edge of the periphery of the lens based on target lens shape data of an eyeglass frame or a template and layout data of the lens with respect to a target lens shape;

arithmetic means for obtaining position data of a contact point between the lens and the chamfering abrasive wheel with respect to a rotational angle of the lens based on the periphery edge position data thus obtained and configuration data of a processing surface of the chamfering abrasive wheel; and control means for controlling operation of the lens rotating means based on the position data of the contact point thus obtained.

2. An eyeglass lens processing apparatus for processing a periphery of an eyeglass lens, comprising:

lens rotating means for holding and rotating the lens;

a chamfering abrasive wheel rotating shaft axially supporting at least one chamfering abrasive wheel and having a rotational axis different from an axis about which a rough abrasive wheel and a finish abrasive wheel are rotatable;

moving means for moving the chamfering abrasive wheel between a retreated position and a processing position;

urging means for urging the chamfering abrasive wheel toward the lens during chamfering processing;

detecting means for obtaining position data of an edge of the periphery of the lens based on target lens shape data of an eyeglass frame or a template and layout data of the lens with respect to a target lens shape;

arithmetic means for obtaining position data of a contact point between the lens and the chamfering abrasive wheel with respect to a rotational angle of the lens based on the periphery edge position data thus obtained and configuration data of a processing surface of the chamfering abrasive wheel, and obtaining lens rotational velocity data for making a moving speed of the contact point substantially constant based on the position data of the contact point thus obtained; and control means for controlling operation of the lens rotating means based on the lens rotational velocity data thus obtained;

wherein the chamfering abrasive wheel rotating shaft supports the chamfering abrasive wheel and a grooving abrasive wheel coaxially.

3. The eyeglass lens processing apparatus of claim 2, wherein the chamfering abrasive wheel rotating shaft axially supports the chamfering abrasive wheels and the grooving abrasive wheel interposed between the chamfering abrasive wheels, each of the chamfering abrasive wheels having a processing surface decreased in diameter as it is located further from the grooving abrasive wheel.

4. The eyeglass lens processing apparatus of claim 2, wherein the chamfering abrasive wheel rotating shaft is inclined relative to a rotational axis of the lens rotating means.

5. The eyeglass lens processing apparatus of claim 4, wherein the chamfering abrasive wheel rotating shaft is inclined at an angle of about 8 degrees relative to the rotational axis of the lens rotating means.

6. The eyeglass lens processing apparatus of claim 2, wherein the chamfering abrasive wheel rotating shaft is inclined relative to a rotational axis of the lens rotating means so that the grooving abrasive wheel extends along a curvature of an optical plane of the lens.

7. The eyeglass lens processing apparatus of claim 2, further comprising:

an input key for changing a chamfering amount;

wherein the arithmetic means obtains the lens rotational velocity data in accordance with the chamfering amount designated by the input key.

8. The eyeglass lens processing apparatus of claim 2, further comprising:

an input key for changing a chamfering amount;

wherein the control means controls rotation number of the lens required for the chamfering processing in accordance with the chamfering amount designated by the input key.

9. The eyeglass lens processing apparatus of claim 2, further comprising:

selecting means for selecting whether or not the chamfering processing is performed.

10. The eyeglass lens processing apparatus of claim 2, wherein:

the arithmetic means obtains chamfering processing data based on radius vector data and the peripheral edge position data based on the target lens shape data and the layout data; and the control means controls, based on the chamfering processing data thus obtained, an axis-to-axis distance between a rotational axis of the lens rotating means and the rotational axis of the chamfering abrasive wheel rotating shaft, and a relative position of the lens with respect to the chamfering abrasive wheel in a direction of the rotational axis of the lens.

11. The eyeglass lens processing apparatus of claim 2, wherein:

the arithmetic means obtains grooving processing data based on radius vector data and the peripheral edge position data based on the target lens shape data and the layout data; and the control means controls, based on the grooving processing data thus obtained, an axis-to-axis distance between a rotational axis of the lens rotating means and the rotational axis of the chamfering abrasive wheel rotating shaft, and a relative position of the lens with respect to the grooving abrasive wheel in a direction of the rotational axis of the lens.

12. The eyeglass lens processing apparatus of claim 1, wherein:

the moving means moves the grooving abrasive wheel between a retreated position and a processing position, the arithmetic means obtains grooving processing data based on the periphery edge position data, and the control means controls, based on the grooving processing data thus obtained, an axis-to-axis distance between a rotational axis of the lens rotating means and the rotational axis of the chamfering abrasive wheel rotating shaft, and a relative position of the lens with respect to the grooving abrasive wheel in a direction of the rotational axis of the lens.

13. The eyeglass lens processing apparatus of claim 11, wherein the chamfering abrasive wheel rotating shaft axially supports the chamfering abrasive wheels and the grooving abrasive wheel interposed between the chamfering abrasive wheels, each of the chamfering abrasive wheels having a processing surface decreased in diameter as it is located further from the grooving abrasive wheel.

14. The eyeglass lens processing apparatus of claim 11, wherein the chamfering abrasive wheel rotating shaft is inclined at an angle of about 8 degrees relative to the rotational axis of the lens rotating means.

15. An eyeglass lens processing apparatus for processing a periphery of an eyeglass lens, comprising:

a lens processing unit including:

a lens chuck shaft which holds and rotates the lens;

a first abrasive wheel rotating shaft which rotates a rough abrasive wheel and a finish abrasive wheel;

a second abrasive wheel rotating shaft which rotates a chamfering abrasive wheel;

a moving mechanism which moves the chamfering abrasive wheel between a retreated position and a processing position; and an urging mechanism which urges the chamfering abrasive wheel toward the lens during chamfering processing;

an input unit which inputs target lens shape data of an eyeglass frame or a template and layout data of the lens with respect to a target lens shape;

a lens measuring unit which obtains position data of an edge of the periphery of the lens based on the target lens shape data and the layout data thus inputted; and an arithmetic control unit which obtains position data of a contact point between the lens and the chamfering abrasive wheel with respect to a rotational angle of the lens based on the periphery edge position data thus obtained and configuration data of a processing surface of the chamfering abrasive wheel, obtains lens rotational velocity data for making a moving speed of the contact point substantially constant based on the position data of the contact point thus obtained, and controls operation of the lens chuck shaft based on the lens rotational velocity data thus obtained;

wherein the second abrasive wheel rotating shaft supports the chamfering abrasive wheel and a grooving abrasive wheel coaxially.

16. The eyeglass lens processing apparatus of claim 15, wherein:

the arithmetic control unit obtains grooving processing data based on radius vector data and the peripheral edge position data based on the target lens shape data and the layout data, and controls, based on the grooving processing data thus obtained, an axis-to-axis distance between a rotational axis of the lens chuck shaft and the rotational axis of the second abrasive wheel rotating shaft, and a relative position of the lens with respect to the grooving abrasive wheel in a direction of the rotational axis of the lens.

17. The eyeglass lens processing apparatus of claim 15, wherein the second abrasive wheel rotating shaft axially supports the chamfering abrasive wheels and the grooving abrasive wheel interposed between the chamfering abrasive wheels, each of the chamfering abrasive wheels having a processing surface decreased in diameter as it is located further from the grooving abrasive wheel.

18. The eyeglass lens processing apparatus of claim 15, wherein the second abrasive wheel rotating shaft is inclined relative to a rotational axis of the lens chuck shaft.

19. The eyeglass lens processing apparatus of claim 18, wherein the second abrasive wheel rotating shaft is inclined at an angle of about 8 degrees relative to the rotational axis of the lens chuck shaft.

20. The eyeglass lens processing apparatus of claim 15, wherein the second abrasive wheel rotating shaft is inclined relative to a rotational axis of the lens chuck shaft so that the grooving abrasive wheel extends along a curvature of an optical plane of the lens.

21. The eyeglass lens processing apparatus of claim 15, further comprising:

an input key which changes a chamfering amount;

wherein the arithmetic control unit obtains the lens rotational velocity data in accordance with the chamfering amount designated by the input key.

22. The eyeglass lens processing apparatus of claim 15, further comprising:

an input key which changes a chamfering amount;

wherein the arithmetic control unit controls rotation number of the lens required for the chamfering processing in accordance with the chamfering amount designated by the input key.

23. The eyeglass lens processing apparatus of claim 15, wherein:

the arithmetic control unit obtains chamfering processing data based on radius vector data and the peripheral edge position data based on the target lens shape data and the layout data, and controls, based on the chamfering processing data thus obtained, an axis-to-axis distance between a rotational axis of the lens chuck shaft and the rotational axis of the second abrasive wheel rotating shaft, and a relative position of the lens with respect to the chamfering abrasive wheel in a direction of the rotational axis of the lens.

* * * * *